US005783791A

United States Patent [19]

Tamura et al.

[11] Patent Number: 5,783,791

[45] Date of Patent: Jul. 21, 1998

[54] GAS INSULATED INTERRUPTER

[75] Inventors: Wataru Tamura; Toru Tsubaki, both of Hitachi, Japan

[73] Assignee: Hitachi, Ltd., Tokyo, Japan

[21] Appl. No.: 797,612

[22] Filed: Feb. 7, 1997

[30] Foreign Application Priority Data

Feb. 9, 1996 [JP] Japan ..... 8-023957

[51] Int. Cl.[6] ..... H01H 33/88

[52] U.S. Cl. ..... 218/57; 218/59; 218/60

[58] Field of Search ..... 218/43, 44, 46, 218/51–54, 57–64, 66, 68, 71–73, 86, 88

[56] References Cited

U.S. PATENT DOCUMENTS

| | | | |
|---|---|---|---|
| 3,991,292 | 11/1976 | Perkins | 218/57 |
| 4,665,289 | 5/1987 | Yanabu et al. | 218/57 |
| 5,229,561 | 7/1993 | Seki et al. | 218/57 |
| 5,543,597 | 8/1996 | Watanabe et al. | 218/60 |

FOREIGN PATENT DOCUMENTS 63-198145 12/1988 Japan .

3-67431 3/1991 Japan .

*Primary Examiner*—Khanh Dang

*Attorney, Agent, or Firm*—Fay, Sharpe, Beall, Fagan, Minnich & McKee

[57] ABSTRACT

A puffer-type gas insulated interrupter has stationary and moving main contacts, stationary and moving arc contacts for discharging an arc, and a puffer cylinder for electric arc suppression. At the time of current interruption, the puffer cylinder moves together with the moving arc contact to blow electric insulation gas to the arc between the stationary and moving arc contacts. The blown gas flows between the arc contacts and is then discharged through a gas discharge passage. A duplex puffer chamber is provided in the gas discharge passage near the moving arc contact. The duplex puffer chamber holds or confines the insulation gas, and causes the same to be heated and pressurized by the arc and to blow out toward the stationary arc contact. A gas flow from the duplex puffer chamber cooperates with a gas flow from the puffer cylinder to effectively suppress the arc, and therefore the gas pressure in the puffer cylinder can be reduced, so that an operating force for the interrupter can be reduced.

8 Claims, 2 Drawing Sheets

GAS INSULATED INTERRUPTER

BACKGROUND OF THE INVENTION

The present invention relates to a gas insulated interrupter, and more particularly to a gas insulated interrupter with a puffer cylinder and a puffer piston blowing insulation gas for electric arc suppression.

A commonly-used, conventional gas insulated interrupter of the type described comprises stationary and moving arc contacts for producing an electric arc at the time of current interruption, and a puffer cylinder and a puffer piston are provided on the moving arc contact side. During the current interruption operation, the puffer piston compresses insulation gas within the puffer cylinder in accordance with the movement of the moving arc contact. The compressed gas is blown through a nozzle to distal ends of the arc contacts to suppress the arc. Such a construction is disclosed, for example, in Japanese Patent Unexamined Publication No. 3-67431.

Japanese Utility Model Unexamined Publication No. 63-19814 proposes, in addition to the above construction, the provision of a gas heating chamber on the stationary arc contact side. The gas heating chamber is formed in a hollow cylinder at a central portion of the stationary arc contact and adapted to hold insulation gas. This construction is intended to heat and pressurize the gas within the gas heating chamber by the heat of an arc during an interruption operation so as to increase the force of blowing of the gas and effectively suppress the arc.

Also in the construction as disclosed in Japanese Patent Unexamined Publication No. 3-67431, a hole for discharging the blown gas is usually formed on the moving arc contact side, and more specifically in a puffer shaft supporting the puffer cylinder. This hole is expected to increase the gas blowing force since the gas in this hole is subjected to the arc and is heated.

However, it has been found through experiments and analysis by the present inventors that the above two constructions have the following problems:

The hole in the puffer shaft needs to have a certain size sufficient enough to discharge the gas, and the volume to be heated is relatively large. Therefore, in this construction, at the time of the high current interruption in which the arc is large, and the heating force is high, the gas can be heated sufficiently to effectively suppress the arc. However, at the time of the low current interruption, the gas often fails to be heated sufficiently.

On the other hand, in the construction proposed by Japanese Utility Model Unexamined Publication No. 63-19814, a gas flow, produced at an initial stage of the interruption operation, causes the arc to flow from the distal end of the stationary arc contact to the outer side thereof, so that the gas in the heating chamber is not pressurized satisfactorily.

In this construction, further, a gas flow from the puffer cylinder on the moving contact side and a gas flow from the heating chamber on the stationary contact side impinge upon each other between the stationary and moving contacts. Therefore, the gas flow for arc suppression purposes is disturbed, and as a result the arc is suppressed effectively in some cases, and is not suppressed in other cases, thus affecting the stability of the interruption performance.

SUMMARY OF THE INVENTION

The present invention has been accomplished in view of the above problems, and it is an object of the invention to provide a gas insulated interrupter which can effectively suppress an arc regardless of the magnitude of the an interruption current, and therefore has an excellent interruption performance.

A gas insulated interrupter according to the invention includes stationary main and arc contacts, moving main and arc contacts movable into and out of contact with the stationary main and arc contacts, respectively, a puffer cylinder defining a puffer chamber for receiving electric insulation gas therein, a puffer piston movably associated with the puffer cylinder for compressing the gas in the puffer chamber, a puffer shaft connecting the moving arc contact with one of the puffer cylinder and the puffer piston for driving thereof, an insulated nozzle for guiding the compressed gas from the puffer chamber to distal ends of the stationary and moving arc contacts, and a gas discharge passage axially extending through a central portion of the moving arc contact. The interrupter further comprises a duplex puffer chamber which is provided in the gas discharge passage adjacent to the moving arc contact to hold or confine the insulation gas therein, so that at the time of current interruption, the insulation gas, held in the duplex puffer chamber, is heated and pressurized by an electric arc produced between the stationary and moving arc contacts to blow out of the duplex puffer chamber.

In the interrupter of this construction, the duplex puffer chamber provides a space for holding the insulation gas in the gas discharge passage adjacent to the moving arc contact. This space is small in volume as compared with the gas discharge passage, and therefore even at the time of low current interruption, the gas, held or confined in the duplex puffer chamber, is sufficiently heated by the arc to be efficiently pressurized and blows toward the stationary arc contact. The interrupter can thus efficiently suppress the arc regardless of the magnitude of the interruption current and is excellent in interruption performance. Further, a flow of the gas from the duplex puffer chamber cooperates with a gas flow from the puffer cylinder to effectively suppress the arc, and therefore the gas pressure in the puffer cylinder can be reduced. This leads to a reduction in the operating force of the interrupter required for pressurizing the gas, thereby enabling the operating construction to be made compact.

BRIEF DESCRIPTION OF THE DRAWINGS

The above and other features and advantages of the invention will become more apparent from the following description which will be made with reference to a preferred embodiment shown in the accompanying drawings, in which.

DESCRIPTION OF THE PREFERRED EMBODIMENT

Figure 1:
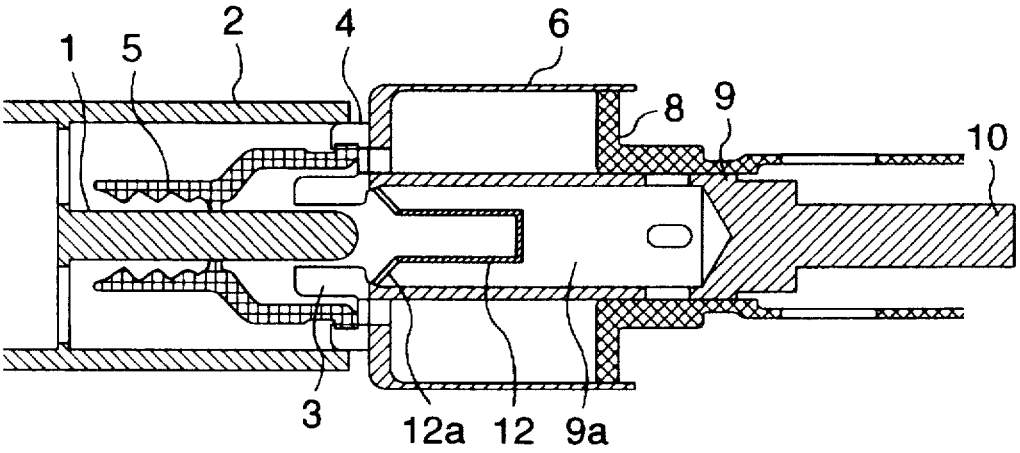
FIG. 1 is a sectional side view showing the gas insulated interrupter according to the embodiment of the invention in a state that its interruption portion is closed.
Figure 2:
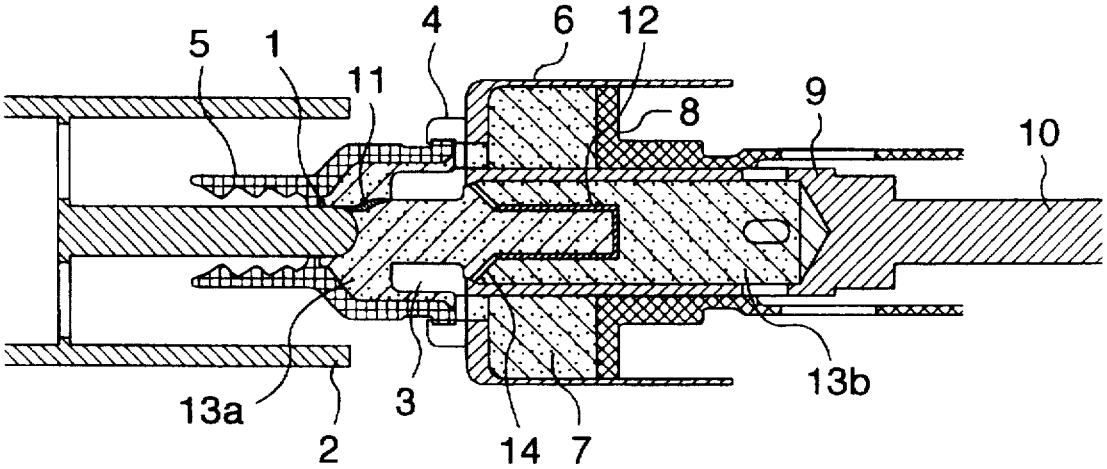
FIG. 2 is a sectional side view showing the interruption portion of FIG. 1 during an opening operation.
Figure 3:
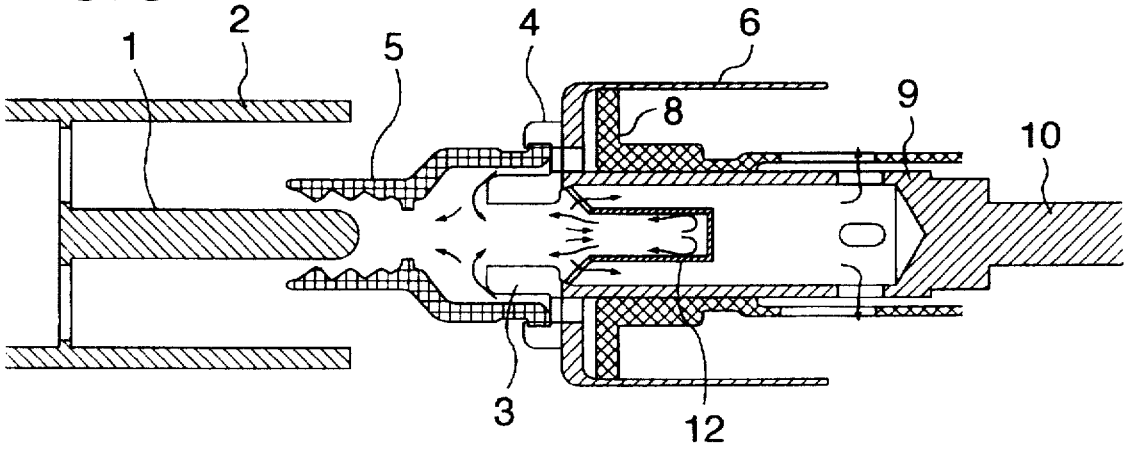
FIG. 3 is a sectional side view showing the interruption portion of FIG. 1 after completion of the opening operation.

FIGS. 1 to 3 show in section the interruption portion of a puffer-type gas insulated interrupter according to the embodiment of the invention. Although not shown in the drawings, the gas insulated interrupter includes a grounded or earthed tank sealed by bushings and flanges. The grounded tank is filled with an electrically-insulation gas such as SF6, and the interruption portion is housed in this tank. Such a gas insulated interrupter is used as the central equipment in a single gas circuit breaker (GCB) or a single gas insulated switchgear (GIS), fixed by an insulated supporting cylinder.

The interruption portion comprises stationary and moving arc contacts 1, 3 provided at a central portion thereof, and stationary and moving main contacts 2, 4 coaxially arranged outside the stationary and moving arc contacts. The arc contacts 1, 3 are adapted to, at the time of current interruption, come apart from each other slightly after the main contacts 2, 4 are brought apart from each other, and serve to discharge an arc.

On the moving contact side, a cylindrical puffer cylinder 6 and a puffer piston 8, which is slidable in the cylinder 6, are provided. The puffer cylinder 6 has a puffer cylinder shaft 9 formed at a central portion thereof. The shaft 9 extends through the puffer piston 8 in a direction away from the stationary contacts 1, 2 and is connected to an operating rod 10. The puffer cylinder 6 is driven by the operating rod 10 to be movable to and away from the stationary contacts 1, 2. The moving and main arc contacts 3, 4 are fixedly secured to an end of the puffer cylinder 6 facing the stationary contacts 1, 2.

Further on the puffer cylinder end, provided are holes for passage of the insulation gas and an insulated nozzle 5. The nozzle 5 is in a substantially cylindrical shape and extends from the vicinity of the holes, formed in the cylinder 6, toward the stationary arc contact 1, while covering the moving arc contact 3. On the other hand, the puffer piston 8 is fixed or stationary, and when the puffer cylinder 6 is moved away from the stationary contacts 1, 2 at the time of current interruption, the puffer piston 8 compresses the insulation gas 7 in the cylinder 6, as shown in FIG. 2. The compressed gas blows out of the cylinder through its holes and is fed or guided by the nozzle 5 to the distal ends of the stationary and moving arc contacts 1, 3. The gas then flows through a gas discharge passage 9*a*. The gas discharge passage 9*a* is formed to axially extend through the central portions of the moving arc contact 3 and the puffer cylinder shaft 9 and is open to the outer periphery of the shaft 9.

The contacts, the puffer cylinder and so forth described above may be similar to conventional ones, and further explanation thereof will be omitted.

According to the invention, a duplex puffer chamber 12 is provided in the gas discharge passage 9*a* near the moving arc contact 3. The duplex puffer chamber 12 is open at its end adjacent to the moving arc contact, and has a gas-flow passage 14 formed around the open end.

The duplex puffer chamber 12 is made of cast aluminum, and has a bottomed cylindrical shape, as shown in the drawings. However, the duplex puffer chamber may be formed of any other suitable heat-resistant metal in another shape. The duplex puffer chamber 12 has a flange 12*a* formed on a periphery of its open end, and the passage 14 is formed through the flange 12*a*. The duplex puffer chamber 12 is disposed at the central portion of the gas discharge chamber 9*a* in coaxial relation thereto, with the flange 12*a* fixedly secured to the cylinder 6 by bolts or the like. The flange 12*a* is inclined or tapering in a direction away from the stationary contacts 1, 2. The passage 14 comprises a plurality of holes formed through the flange 12*a* and circumferentially spaced from one another.

When the interruption portion of the above construction is in a closed condition, the stationary and moving main contacts 2, 4 contact each other, and also the stationary and moving arc contacts 1, 3 contact each other, so that an electric current flows between each pair of mating contacts.

On the other hand, when the current is interrupted, an electric arc 11, indicated in black in FIG. 2, is produced between the stationary and moving arc contacts 1, 3. At this time, the insulation gas 7 is blown or injected from the puffer cylinder 6 to the arc 11, as described above. At the same time, the gas in the vicinity of and in the duplex puffer chamber 12 is heated by the arc to have a very high pressure as at 13*a*. Further, since the gas discharge passage 9*a* communicates with the space on the contact side through the passage 14, the pressure within the gas discharge passage 9*a* becomes high as at 13*b*. As a result, the gas, blowing out of the duplex puffer chamber 12, forms a flow directed toward the stationary arc contact 1, and effectively suppresses the arc 11 in cooperation with the gas flowing from the puffer cylinder 6.

Preferably, the size of the duplex puffer chamber 12 is suitably determined in accordance with the performance of the gas insulated interrupter to which the invention is applied. For example, when the invention was applied to an interrupter of 550 KV and 63 KA, suitable sizes of the duplex puffer chamber relative to the discharge passage 9*a*, having a length of about 250 mm and a diameter of 73 mm, were about 100 mm length and 36 mm diameter.

By thus providing the duplex puffer chamber, a small volume of the gas, as compared with that by the gas discharge passage 9*a*, can be arrested and effectively heated and pressurized by the arc. Even at the time of low current interruption, therefore, the gas can be pressurized to a high level, and also this pressure of the gas can be easily maintained. Further, since the duplex puffer chamber 12 is provided in the axis of the gas discharge passage 9*a*, the gas can flow straight from the duplex puffer chamber toward the nozzle, so that the arc can be stably suppressed without disturbing the gas flow.

Moreover, since the flange 12*a* is inclined or tapered, a passage of the size necessary for good discharge of the gas can be obtained without increasing the size of the flange 12*a*. As a result, the gas heating chamber can be made more compact, so that the pressurizing of the gas can be further enhanced.

Figure 4:
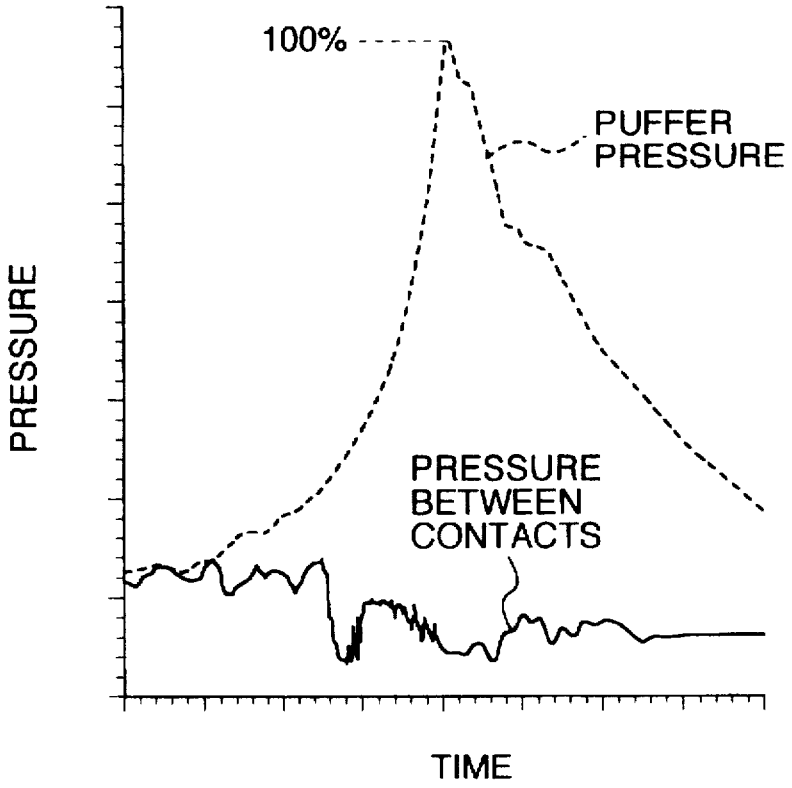
FIG. 4 PRIOR ART
FIG. 4 is a diagram showing gas pressure characteristics of a conventional gas insulated interrupter when an interruption portion is in an open operation.
Figure 5:
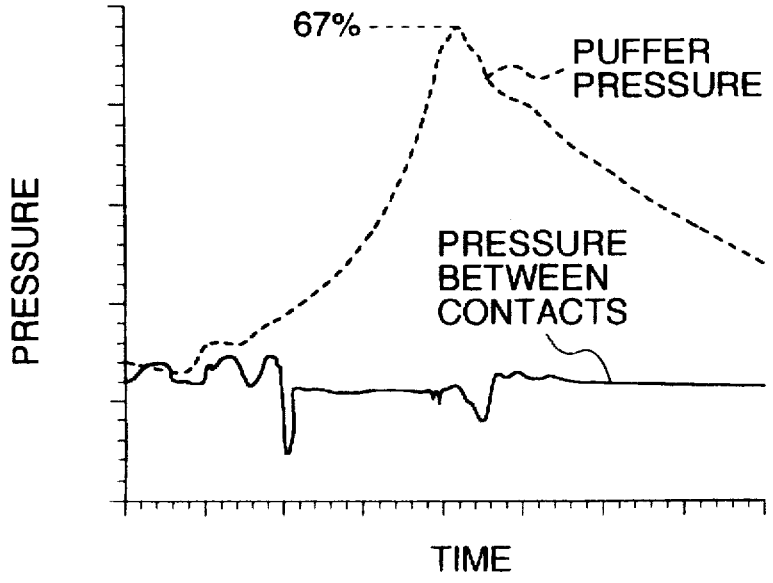
FIG. 5 is a diagram showing gas pressure characteristics of the embodiment of the invention when the interruption portion is in an open operation.

FIG. 4 shows the results of a study of the gas pressure relation by a flow analysis in the interruption portion of a conventional interrupter, and FIG. 5 shows the results of a study of the gas pressure relation by a flow analysis in the embodiment of the invention. As will be appreciated from these results, assuming that the puffer pressure in the conventional interruption portion is 100%, the gas pressure between the contacts in the interrupter of the embodiment is substantially equal to the gas pressure of the conventional interrupter despite the fact that the puffer pressure in the interruption portion of the embodiment is lower, that is, 67%. The decrease of the puffer pressure means that a puffer reaction force is reduced, and the operating force for the puffer cylinder can be reduced. The above results indicate that, as a result of the provision of the duplex puffer chamber, the operating force for the interrupter can be reduced to 67% of that of the conventional interrupter without affecting the interruption performance.

Further, as is clear from FIG. 5, in the interrupter of the embodiment, there occurs a phenomenon in which the pressure between the contacts is higher than the puffer pressure at an initial stage of the interruption operation. This shows that the duplex puffer chamber is very effective for increasing the gas pressure.

As described above, according to the invention, there can be provided the gas insulated interrupter in which, regardless of the magnitude of the interruption current, the insulation gas can be effectively pressurized by the arc heat so as to suppress the arc, wherein an excellent interruption performance is and minimum, required operating force is achieved.

Although the invention has been described with reference to the embodiment, the invention is not limited solely to the specific form, and various changes and modifications can be made or the invention can take even another form without departing from the scope of the appended claims.

What is claimed is:

1. A gas insulated interrupter comprising:

a stationary main and arc contacts;

a stationary arc contact association with said stationary main contact;

a moving main contact movable into and out of contact with said stationary main contact;

a moving arc contact associated with said moving main contact movable along with said moving main contact into and out of contact with said stationary arc contact;

a puffer cylinder defining a puffer chamber for receiving electric insulation gas therein;

a puffer piston movably associated with said puffer cylinder for compressing gas in said puffer chamber;

a puffer shaft connecting said moving arc contact with one of said puffer cylinder and said puffer piston for driving said one of said puffer cylinder and said puffer piston;

an insulated nozzle mounted on said puffer cylinder, said insulated nozzle having a substantially cylindrical shape for covering distal ends of said stationary and moving arc contacts to guide compressed gas from said puffer chamber to said distal ends of said stationary and moving arc contacts;

a gas discharge passage formed axially through said moving arc contact and said puffer shaft; and a duplex puffer chamber provided in said gas discharge passage close to an inlet thereof, said duplex puffer chamber having a bottomed, cylindrical shape for holding electric insulation gas therein, a flange formed on a periphery of said cylindrical duplex puffer chamber and a plurality of gas-flow passages formed through said flange, said duplex puffer chamber being fixedly secured through said flange to an inside of said puffer shaft.

2. An interrupter according to claim 1, wherein said duplex puffer chamber is disposed in coaxial relation to said gas discharge passage.

3. An interrupter according to claim 1, wherein said duplex puffer chamber has an open end facing said stationary arc contact, and said plurality of gas-flow passages communicate with said gas discharge passage.

4. A gas insulated interrupter comprising:

a stationary main contact;

a stationary arc contact associated with said stationary main contact;

a moving main contact movable into and out of contact with said stationary main contact;

a moving arc contact associated with said moving main contact to be movable along with said moving main contact into and out of contact with said stationary arc contact;

a puffer cylinder defining a puffer chamber for receiving electric insulation gas therein;

a puffer piston movably associated with said puffer cylinder for compressing the gas in said puffer chamber;

a puffer shaft connecting said moving arc contact with one of said puffer cylinder and said puffer piston for driving said one of said puffer cylinder and said puffer piston;

an insulated nozzle mounted on said puffer cylinder, said insulated nozzle having a substantially cylindrical shape covering distal ends of said stationary and moving arc contacts, when said stationary and moving arc contacts coming out of contact with each other, for guiding the compressed gas from said puffer chamber to said distal ends of said stationary and moving arc contacts;

a gas discharge passage formed axially through said moving arc contact and said puffer shaft; and a duplex puffer chamber provided in said gas discharge passage close to an inlet thereof, said duplex puffer chamber being fixedly secured to extend inside said puffer shaft for holding electric insulation gas therein, and said duplex puffer chamber having an open end and a plurality of gas-flow passages formed about a peripheral area of said puffer chamber at said open end that communicate with said gas discharge passage.

5. An interrupter according to claim 4, wherein said duplex puffer chamber has a bottomed, cylindrical shape.

6. An interrupter according to claim 4, wherein said duplex puffer chamber has a flange formed in said peripheral area that is fixed to said puffer shaft, and further wherein said plurality of gas-flow passages are formed through said flange.

7. An interrupter according to claim 6, wherein said flange of said duplex puffer chamber is fixed to an inside portion of said puffer shaft.

8. A gas insulated interrupter comprising:

a stationary main contact;

a stationary arc contact associated with said stationary main contact;

a moving main contact movable into and out of contact with said stationary main contact;

a moving arc contact associated with said moving main contact to be movable along with said moving main contact into and out of contact with said stationary arc contact;

a puffer cylinder defining a puffer chamber for receiving electric insulation gas therein;

a puffer piston movably associated with siad puffer cylinder nfor compressing the gas in said puffer chamber;

a puffer shaft connecting said moving arc contact with one of said puffer cylinder and said puffer piston for driving said one of said puffer cylinder and said puffer piston;

an insulated nozzle mounted on said puffer cylinder, said insulated nozzle having a substantially cylindrical shape covering distal ends of said stationary and moving arc contacts, when said stationary and moving arc contacts coming out of contact with each other, for guiding the compressed gas from said puffer chamber to said distal ends of said stationary and moving arc contacts;

a gas discharge passage formed axially through said moving arc contact and said puffer shaft; and a duplex puffer chamber provided in said gas discharge passage close to an inlet thereof, said duplex puffer chamber having a bottomed, cylindrical shape for holding the insulation gas therein, a flange formed on a periphery of said cylindrical duplex puffer chamber and a plurality of gas-flow passages formed through said flange and communicating with said gas discharge passage, said duplex puffer chamber having an open end and being fixedly secured through said flange to an inside of said puffer shaft with said open end facing said stationary arc contact, said flange being tapering in a direction away from said stationary arc contact, said gas-flow passages being spaced circumferentially from one another.

* * * * *